US006329654B1

(12) United States Patent
Gulcicek et al.

(10) Patent No.: US 6,329,654 B1
(45) **Date of Patent: *Dec. 11, 2001**

(54) MULTIPOLE ROD CONSTRUCTION FOR ION GUIDES AND MASS SPECTROMETERS

(75) Inventors: Erol C. Gulcicek, Chesire; Craig M. Whitehouse, Branford; Allan Burt, East Haven; Michael Sansone, Hamden; Clement Catalano, Clinton, all of CT (US)

(73) Assignee: Analytica of Branford, Inc., Branford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/218,664

(22) Filed: Dec. 22, 1998

Related U.S. Application Data

(63) Continuation of application No. 08/887,730, filed on Jul. 3, 1997, now Pat. No. 5,852,294.

(60) Provisional application No. 60/021,194, filed on Jul. 3, 1996.

(51) Int. Cl.[7] ..... H01J 1/88; H01J 49/42

(52) U.S. Cl. ..... 250/293; 250/292; 250/297; 250/288; 250/282; 250/281

(58) Field of Search ..... 250/293, 292, 250/288, 282, 281, 297

(56) References Cited

U.S. PATENT DOCUMENTS

| | | | | |
|---|---|---|---|---|
| 5,852,294 | * | 12/1998 | Gulcicek et al. | 250/292 |
| 6,020,586 | * | 2/2000 | Dresch et al. | 250/287 |
| 6,121,607 | * | 9/2000 | Whitehouse et al. | 250/288 |

* cited by examiner

*Primary Examiner*—Bruce Anderson
*Assistant Examiner*—Nikita Wells
(74) *Attorney, Agent, or Firm*—Levisohn, Lerner, Berger & Langsam

(57) ABSTRACT

A miniature multipole rod assembly, an apparatus and a technique for constructing such an assembly used for ion guide and mass spectrometers.

2 Claims, 7 Drawing Sheets

MULTIPOLE ROD CONSTRUCTION FOR ION GUIDES AND MASS SPECTROMETERS

RELATED APPLICATIONS

This application is a continuation of U.S. patent application Ser. No. 08/887,730 filed Jul. 3, 1997 (issued as U.S. Pat. No. 5,852,294 on Dec. 22, 1998) which claims the priority of U.S. Provisional Patent Application Ser. No. 60/021,194 filed Jul. 3, 1996. All rights of priority to those prior applications are claimed herein.

BRIEF DESCRIPTION OF THE INVENTION

This invention relates generally to multipole rod assemblies used as ion guides and mass analyzers and more particularly to a mounting and a construction technique that allows the assembly of such small size multipole rods.

BACKGROUND OF THE INVENTION

Generally, four, six, eight, or more equally spaced round rods assembled in a circle are used as an ion guide in high efficiency capture, transmission, and/or storage of ions in variety of mass spectrometers. In recent years, the use of such multipole ion guides have been practiced widely, especially in mass spectrometers(MS) interfaced with atmospheric pressure ionization (API) sources. In most of the API MS systems, the ions are generally formed at atmospheric pressure and are carried into a high vacuum chamber where mass analysis of the analyte ions are performed. This process involves the removal of the neutral background gas by large capacity pumps between the ion source and the mass analyzer detector in several stages. Unfortunately, loss of valuable analyte ions between the different pumping stages to a greater extent is unavoidable. An ultimate goal for mass analysis of atmospheric pressure ions would be the removal of the background gas while retaining all of the analyte ions through all of the pumping stages.

To greater extent, the multipole ion guides serve this purpose by capturing the ions and letting the neutral gas be pumped through the rods. This purpose is served better if the ion guide is small and able to go continuously through the different pumping stages and yet minimize the gas flow between the pumping stages. The miniature ion beam guide design, construction, and assembly technique of this invention allows the enrichment of such ions with respect to the background neutral gas. Most mass spectrometers use conical interfaces with small sampling orifice to "skim" ions entrained in the neutral gas expanding into vacuum from atmospheric pressure. The small ion guide design allows the multipole rods to be inserted very close inside the cone across from the sampling orifice allowing more of the ions to be captured without distorting the alternating electric field lines.

If there are four rods per assembly, they are most often used as quadrupole mass analyzers for their ability to filter different mass-to-charge ratio ions. The ideal shape of these rods are hyperbolic; however, in most cases, circular cross sectioned rods can be approximated and are used to generate electric field lines similar to the theoretically ideal hyperbolic field lines between the rods. The Electric field lines are generated by applying AC and DC voltages between the pairs of electrodes which constitute alternating rods in the assembly. If the rod assembly is to be used as an ion guide, only AC voltage is applied to the alternating rods at 180 degrees out of phase from each other. This allows a wide range of mass-to-charge ratio of ions to be stable and transmitted within the ion guide. If a DC voltage is applied between the pair of electrodes in addition to the AC voltage, the multi-rod assemblies are used as a mass filter for a very narrow molecular weight band of ions by adjusting the ratio between the AC and the DC voltages. By keeping the ion guide design small, the electrical capacitance between the rods can be kept to a minimum consuming less power from the resonant driving circuitry.

The overall performance characteristics of an ion guide or a quadrupole mass analyzer judged by its ion transmission efficiency, mass range, sensitivity, and mass resolution is to a high degree determined by the accuracy of the multipole rod assembly. The straightness of the rods, the tolerance build up on all three dimensions of the assembly all play an important role in the accuracy of the results produced by a mass spectrometer. And as the size of the multipole rod assemblies get smaller, it gets harder to maintain the required tolerance levels. In larger rod assemblies conventional machining, welding, brazing and soldering practices can be used to fasten the rods together to keep desired tolerances. In smaller rod assemblies however, the machining becomes prohibitively more difficult and expensive due to lack of material strength, difficulty of handling, and availability of tooling. Voltage connection to the larger rod assemblies are also simpler to make with variety of fastening and brazing methods than the voltage connections to the smaller rod assemblies without distorting or bending them.

To maintain straightness of multipole rods in an assembly can be a challenging task when rod diameters of one mm and rod lengths of beyond 75 mm are being considered. Simple welding or soldering techniques can be implemented if stainless steel rods were to be considered. They are one of the most readily available, inexpensive, and easy to work with materials. Unfortunately, they are easy to bend and very hard to maintain straightness at desired diameter and length combinations. To satisfy straightness, metallic materials such as molybdenum, tungsten or gold coated quartz are commonly used in the art. However, with the desired rod diameters of one mm or less, it becomes almost impossible to fasten any support brackets or connections to the rods. Machining, welding or spot welding, brazing, or soldering of these materials to, for example, stainless steel disks as support structures would be prohibitively difficult and expensive.

Assuming one can obtain desirably straight rods, then one has to assemble them together very accurately. All six rods have to be parallel to each other from end to end. The spacings between the rods have to be equal on a circle, and the end of the rods must meet on a same plane perpendicular to the length of the rods. Once all of these requirements are met, then the complete assembly has to be aligned with the interfacing ion optic lenses and the mass analyzer.

The present invention recognizes the difficulties of having many features in a single yet a small design and be able to overcome the above mentioned design constraints.

OBJECTS AND BRIEF DESCRIPTIONS OF THE INVENTION

It is the principal object of this invention to provide an improved miniature multipole rod assembly for ion guides and mass spectrometers that will improve the ion capture, transmission efficiency, sensitivity, and mass resolution of a mass spectrometer system.

It is an object of this invention to provide an ion guide assembly that will go through different pumping stages, keep the opening between the two pumping stages as small as possible, and also have enough distance between the rods to pump out the background gas from inside the multipole rod assembly without compromising the total number of captured ions inside.

It is a further object of the present invention to keep a good mechanical dimensional tolerance between the rods in the assembly.

It is yet a further object of this invention to have a good electrical connection to the miniature rods and also to keep the capacitance of the rods to a minimal value.

It is a feature of the present invention that the entry end of the rods be very close to and shaped to accept maximum number of ions behind a conical sampling orifice and the exit end of the rods configured to be small enough to fit inside other mass analyzing devices such as a quadrupole, ion trap, and time-of-flight.

It is a further advantage of the present invention that its multipole rod assembly does not have any electrically conductive or dielectric materials that would interfere or disturb the electric field lines defined by the multipole rods and as felt by the ions.

These and further objects, features, and advantages of the present invention will become apparent from the following description, along with the accompanying figures and drawings.

DESCRIPTION OF PREFERRED EMBODIMENT

Figure 1:
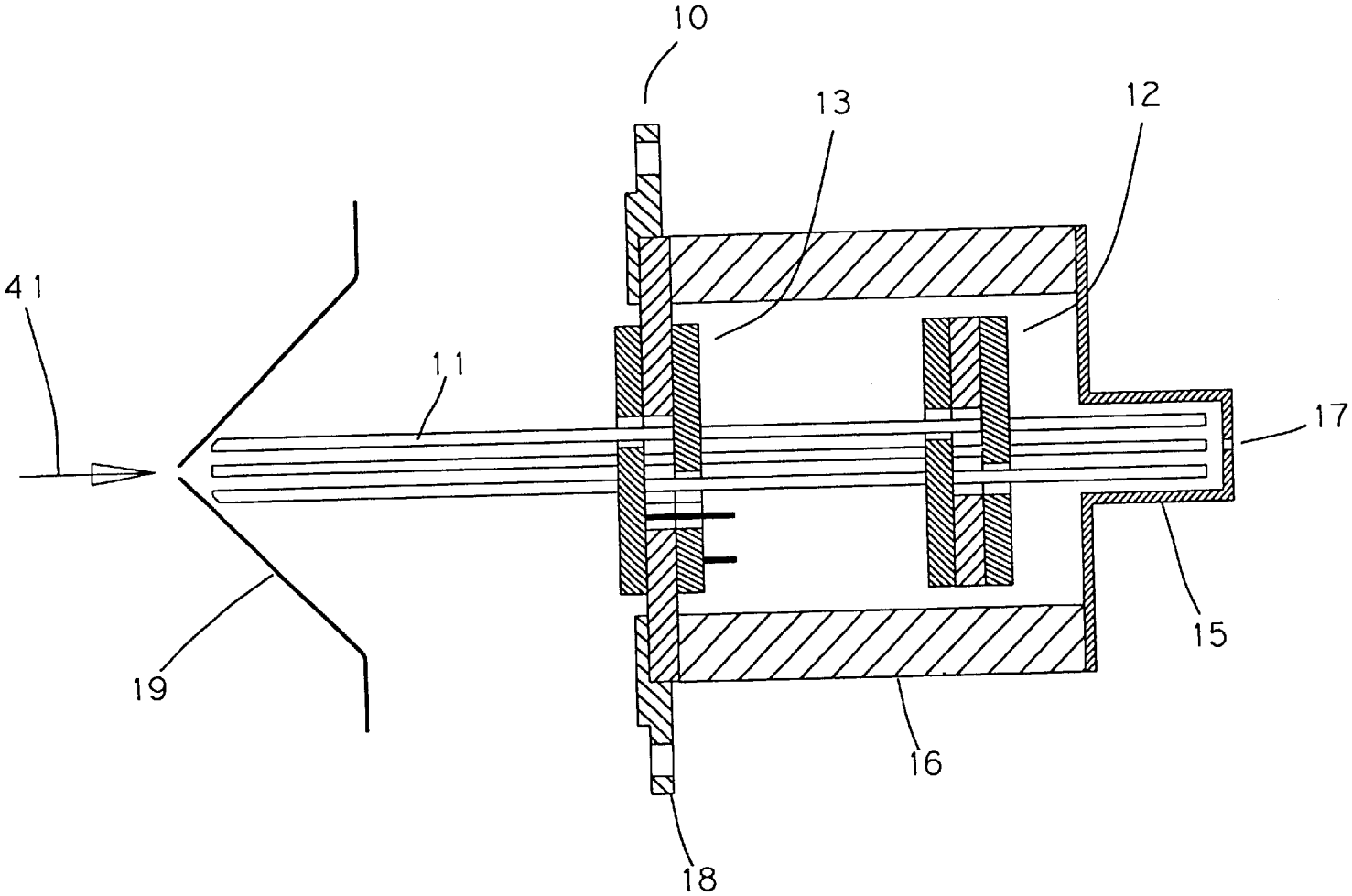
FIG. 1. Shows the complete hexapole rod assembly with the sampling cone.

Although the number of rods used in the assembly and construction of the multipole ion guide or mass spectrometer assemblies may vary, the examples in this invention will show predominantly hexapole, meaning six, rod assembly sets. The schematic side view of the complete hexapole rod assembly 10, as shown in FIG. 1, consists of a six round, equally spaced in a circle, and parallel set of gold coated rods 11. Depending on the length, there are minimum number of two and more attachment assemblies 12 and 13 that act as the support structure, electrical connection, and overall mounting base for other parts that may be used in conjunction with the rod assembly set. For example, the attachment assembly 13 is a mounting base for the mounting ring 18 that allows the complete assembly to be fastened to the rest of the instrument, and it is also a mounting base for an ion optical lens 15 to be mounted with spacers 16 on the ion exit side 17 of the hexapole assembly.

Figure 2:
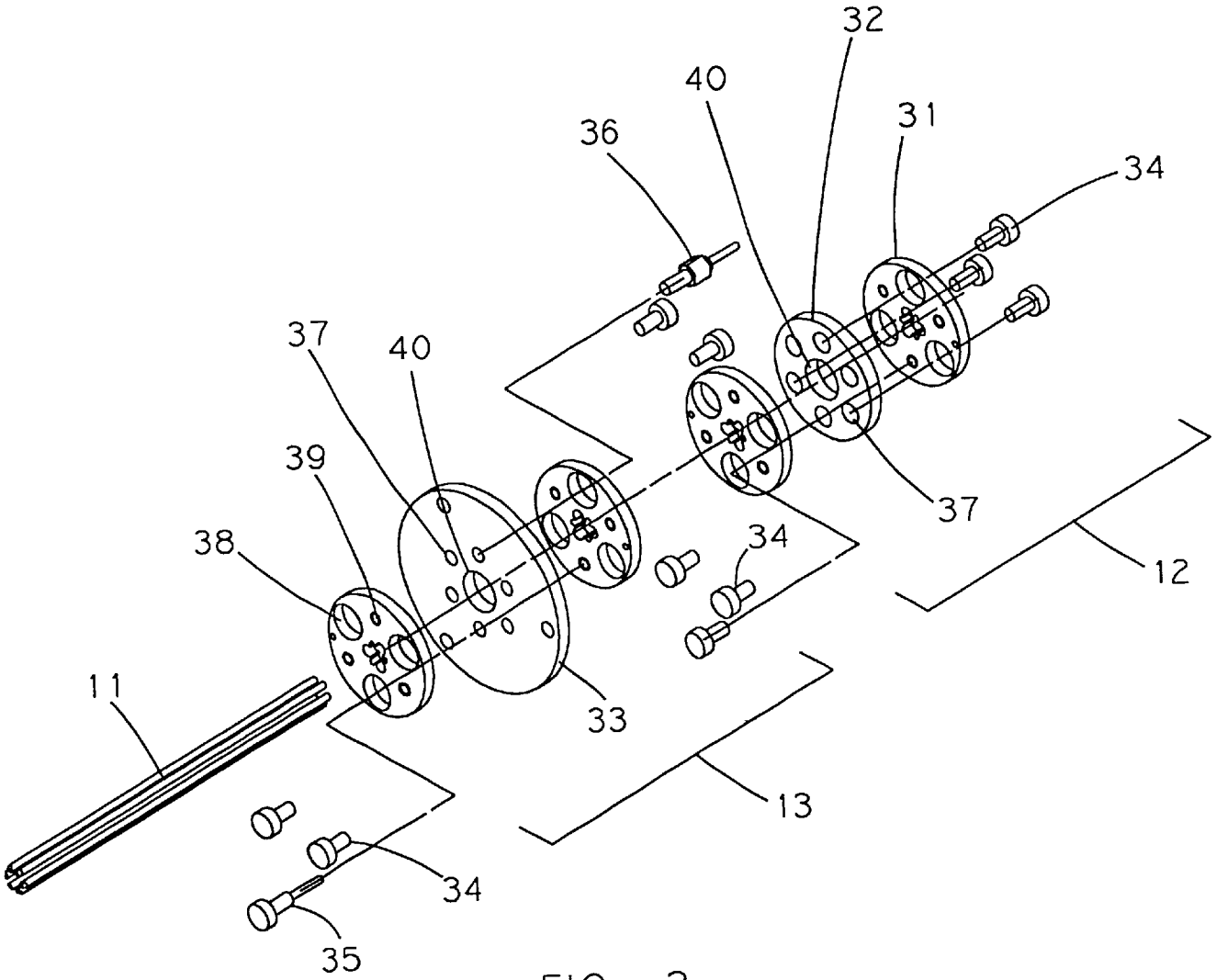
FIG. 2. is the exploded isometric view of the hexapole rod assembly before it would be fixtured for alignment and assembly.
Figure 3:
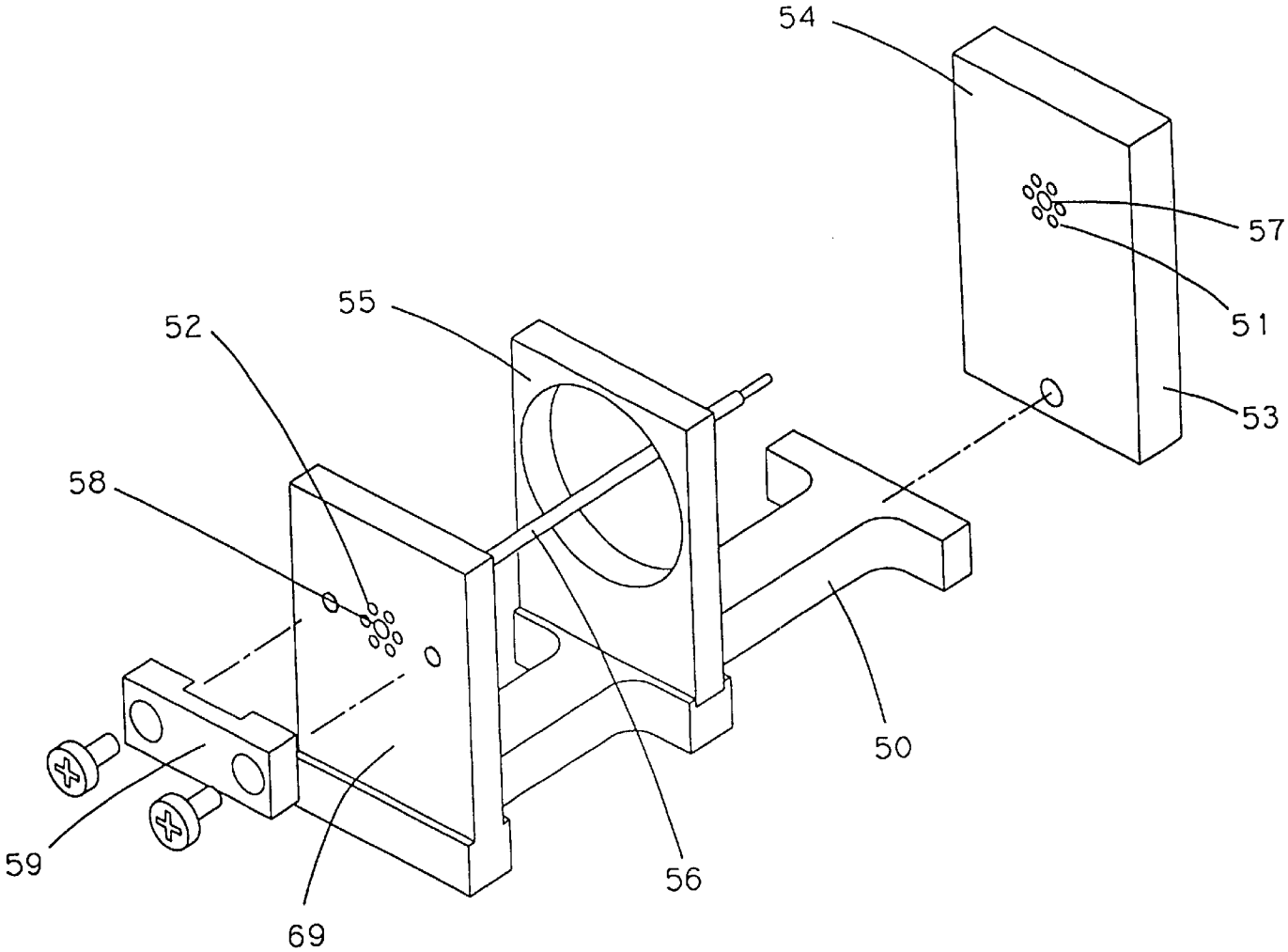
FIG. 3. is the fixture assembly for aligning the attachment and the hexapole rod assemblies.

It is more apparent from the isometric view of the hexapole rod assembly in FIG. 2 how the rods 11 are assembled and held together by the attachment assemblies 12 and 13. Each attachment contains two identical gold coated metal discs 31, rotated 60 degrees and electrically insulated from each other on either side of the ceramic insulator discs 32 or 33. Each attachment assembly is clamped together with total of six screws 34, half of which are fastened from opposite directions. In one of the attachments, for example 13; two of the screws are replaced with connectors 35 and 36. They serve as fastening screws and as pin connection that supplies voltage input to all of the rods. The head of the screws 34 always rest on the surface of the ceramic disks 32 or 33 clearing the metal disk holes 38. They go through the holes 37 on the ceramic disks 32 or 33, and screw into the tapped holes 39 in the metal disks 31. Eventually the gold coated rods are soldered to the attachment assemblies using a fixture assembly 50 shown in FIG. 3.

Figure 4:
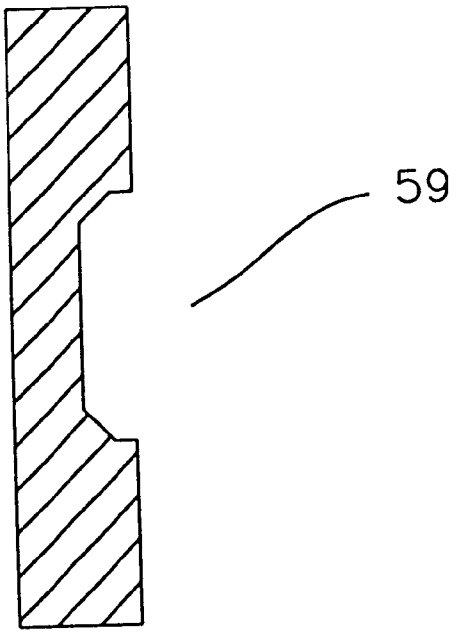
FIG. 4. is the detailed view of the end cap piece on the fixture assembly to rotationally orient the rods.

As mentioned earlier, to have an accurately assembled miniature hexapole rod assembly, all six rods have to be parallel to each other from end to end. The spacings between the rods have to be equal on a circumference of a circle, and the end of the rods must meet on a same plane perpendicular to the length of the rods. Once all of these requirements are met, then the complete assembly has to be square with the interfacing ion optics or the mass analyzer instrument. These requirements are met by using a fixture assembly 50 shown in FIG. 3 The equally spaced pattern of the rod assembly is maintained by the six hole patterns 51 and 52 on both ends of the fixture 50. The end piece 53 of the fixture is removable so the rod assembly can be installed, soldered and be removed. The alignment rod 56 rests by two holes 57 and 58 on both ends of the fixture. The alignment rod 56 allows all of the hexapole rods to be parallel to each other. When rods have different wedge geometries at the ends, their rotational alignment is fixed by the cap 59 placed at the end of the fixture assembly having a matching geometry. FIG. 4 shows one of these caps used for rotationally aligning the rods that are wedged to fit behind a conical shaped sampling orifice. The attachment assemblies 12 and 13 are seated against the fixture surfaces 54 and 55 for accurate alignment of the complete rod assembly with respect to the rest of the instrument.

Figure 5A:
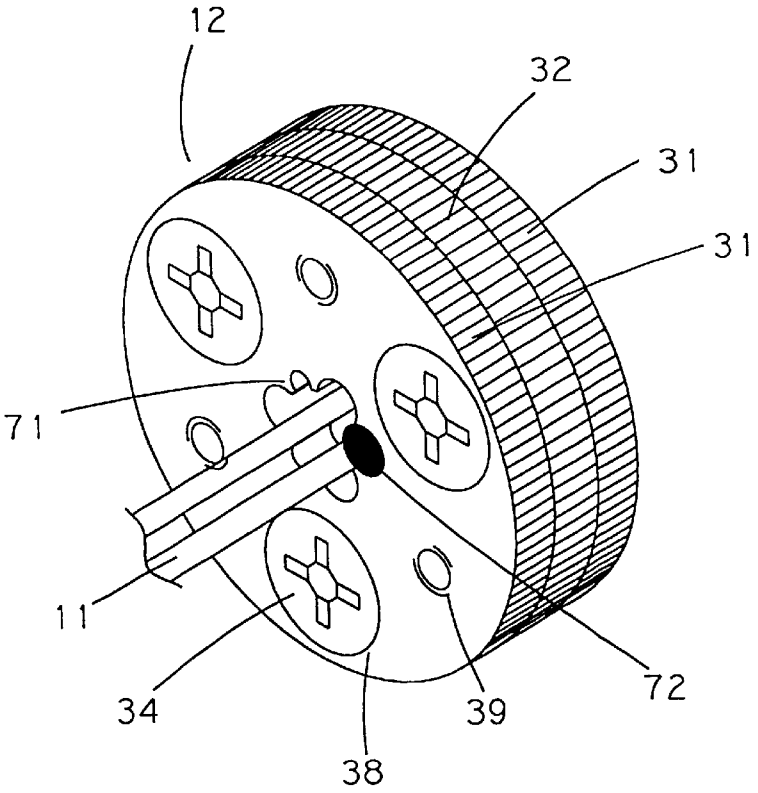
FIGS. 5A. and 5B. are the exploded isometric view of the soldering area showing how the hexapole rods are fastened to the disks in the attachment assemblies.
Figure 5B:
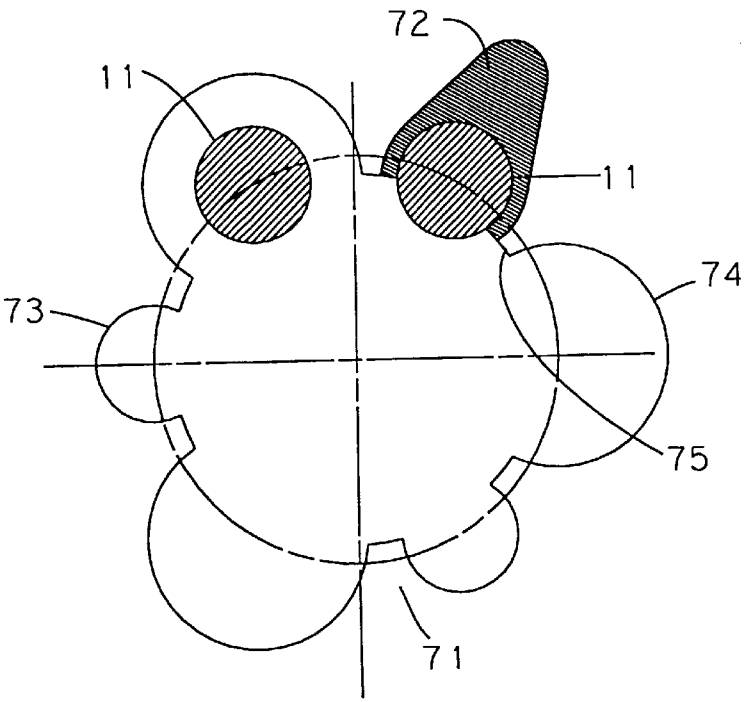

FIG. 5A shows a detailed view of how two of the representative six rods are fastened to the attachment assemblies. The gold coated metal disks 31 have unsymmetrical clover shaped pattern 71 in the center as shown in FIG. 5B. After being gold coated, three of every other six tungsten rods 11 and the smaller three of the interrupted holes 73 on the clover pattern on the metal disks get soldered to each other at joints 72. The other three alternate rods clear the holes 74 on the same metal disk, but they do get soldered to the holes 73 of the metal disk 31 on the other side of the ceramic insulator (60 degree rotated). Naturally, the center hole 40 on the ceramic insulators 32 and 33 clear the rods. On making the solder joints 72, extreme care must be taken not to overflow the materials around the rods 11 or the outer edge 75 of the interrupted hole 73 on the metal disk, for any physical perturbation inside the six rods will negatively effect the electric field, hence, the mass spectral performance. The clover shape 71, especially the amount of allowable material on the hole 73 around the rods were carefully chosen not to disturb the electric field generated by the six rod electrodes. Yet, to achieve limited gas flow between two pumping stages, the holes 73 were cut out to be as large as possible. It was found that approximately half or slightly more than half circumference interruption on the hole 73 was optimum for both minimal electric field distortion and minimal gas throughput.

To comply with the rigidity aspects of the rods, of the many materials that can be used, the present invention uses accurately ground 1.0 mm diameter tungsten rods that can vary in length. As mentioned earlier, many rigid metal materials such as tungsten, molybdenum, and the like cannot be directly brazed or welded on to other support materials without damaging or altering the straightness of the rods due to excessive heat. Soldering directly is not an option since many available soldering alloys do not bind to these types of metals. Electrically conductive or insulating epoxy was a consideration, however, it was experienced many times that in a small assembly setting, the flow of such epoxy materials could not be controlled to the exact needed location 72. In addition, conductive epoxy lacked the material strength, and the insulating epoxies did not assure a definitive electrical contact to the rods, neither could they be relied upon as materials to be so close to the path of the ions. Surface charge effects from ions on the surface of insulating materials could build large electric fields inside the rods cutting off ion transmission. Poor chemical resistance of many epoxies to commonly used solvents were also a deterrent on their use in the assembly. As mentioned earlier, due to the small diameter nature of the rods, mechanical fastening of the assembly parts were not considered. To bind the hexapole rods 11 to the metal discs 31, all parts were first gold coated. It is a well known practice in the jewelry field that Indium alloys can be used to solder gold or gold coated objects. A technique was developed in house to use Indium alloy as soldering material. Strong soldering joints 72 were established between the back side of the rods and the surface of the metal disk 31 as much away from the open space between the hexapole rods as possible.

Figure 6:
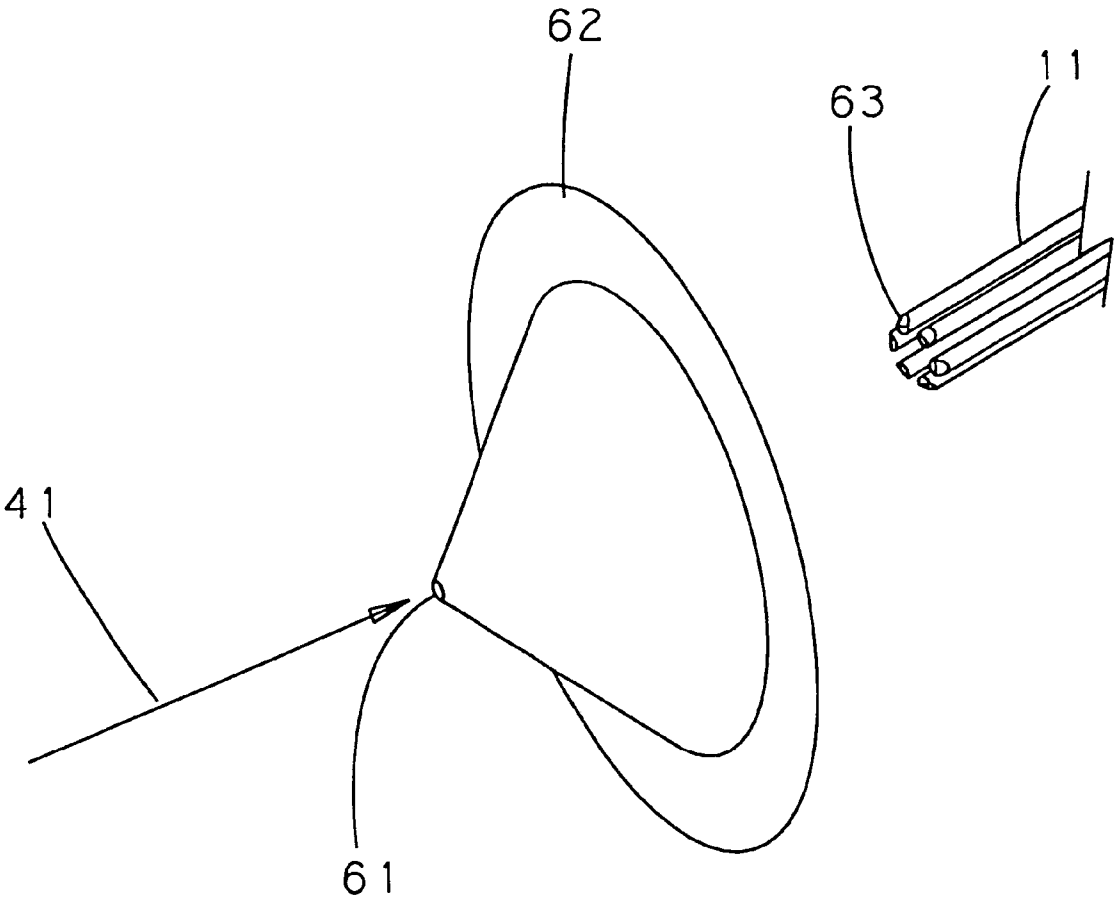
FIG. 6. is the isometric detailed view of the entry end of the rods shown with a possible conical sampling orifice.

The ion entry section 41 of the rod assembly 10 is shown in FIG. 6. Most common ion sampling orifices 61 used in the API MS instruments are situated at the tip of conical shaped electrodes 62. To achieve maximum number of ions entering into the ion guide from the orifice, the tip of the rods 63 are beveled parallel to the walls of the cone prior to gold coating process. This allows the rod assembly to come as close to the sampling orifice as possible, especially when the rod diameter and the overall rod-to-rod distance is small. While the ions are captured inside the rods emanating from the aperture 61, the background gas is pumped out through between the rods.

Figure 7B:
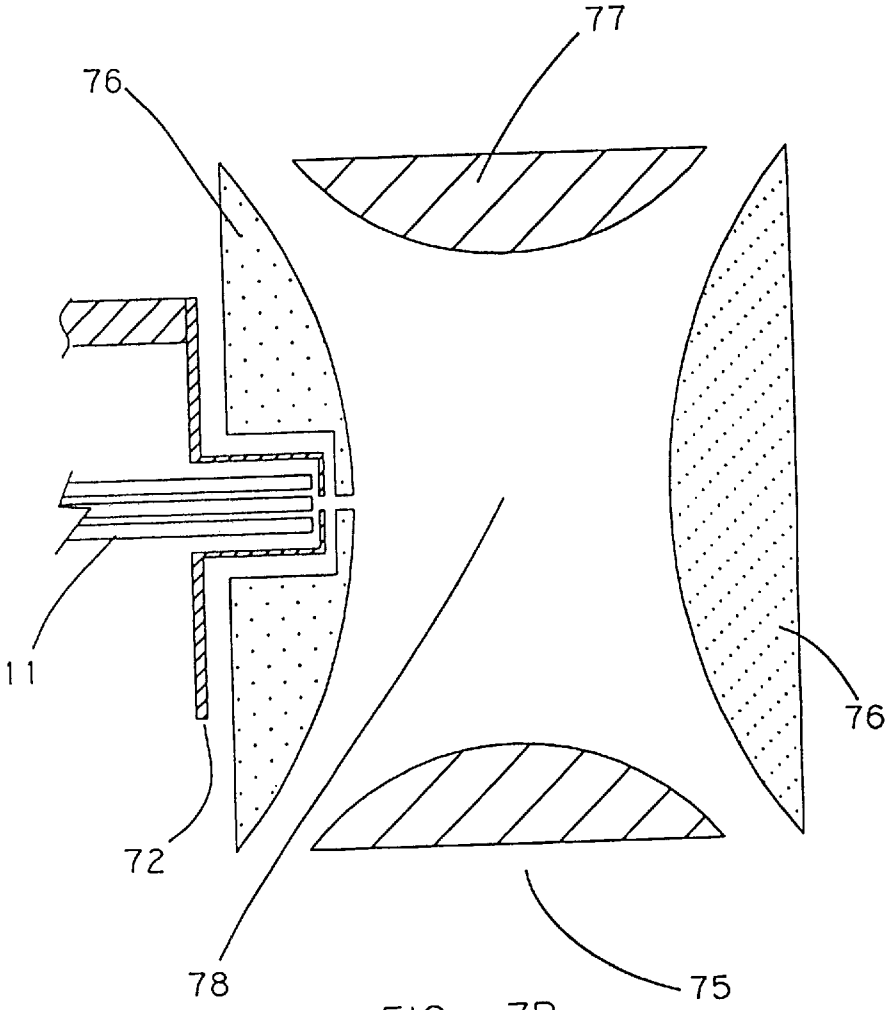
FIGS. 7A and 7B. show the detailed view of the exit end of the ion guide with two possible mass analyzer interfaces, namely, quadrupole and an ion trap.
Figure 7A:
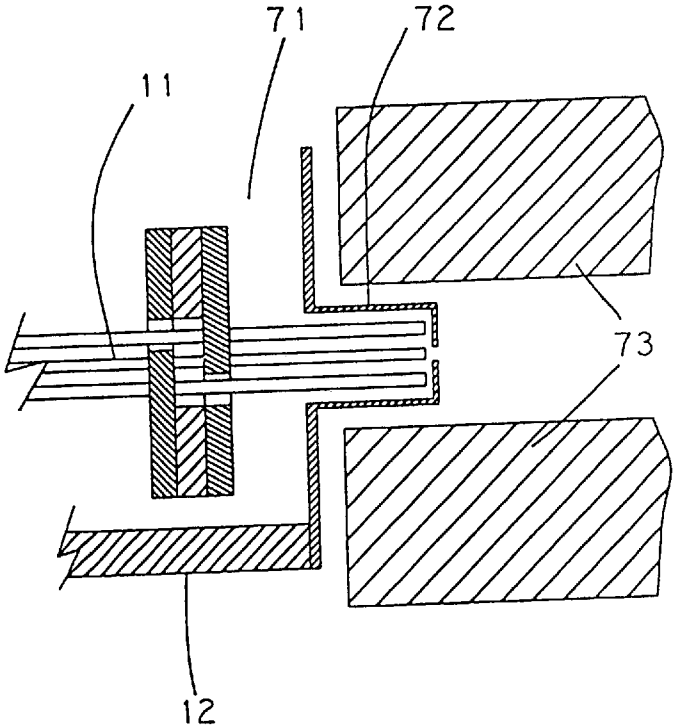

The overall small size of the hexapole rods also allows the exit end of the assembly to interface to other mass analyzers. For example, the small multipole rod assemblies can more effectively interface to quadrupole mass analyzers by penetrating inside them which generally have larger rod diameters and rod to rod distances. FIG. 7A shows such an interface 71 where the hexapole rods 11 and the hexapole exit lens 72 penetrates inside the quadrupole rod set 73. Another type of interface 75 can also be shown for three dimensional ion trap mass spectrometers on FIG. 7B. To come as close to an ion storage space 78 of a three dimensional ion trap as possible, the hexapole rods 11 and the hexapole exit lens 72 penetrates inside the end cap 76 of an ion trap having a ring electrode 77 and two end cap electrodes 76.

What is claimed is:

1. A multipole rod assembly used as ion guides or as mass filters comprising a plurality of aligned and spaced gold coated rigid rods made of metal materials such as tungsten, molybdenum, tantalum, or glass, quartz, or ceramic each having a diameter less than 2.5 mm (0.10 inches)

a plurality of rigid rods having beveled edges in different shapes to get into close proximity of conical of differently shaped ion sampling orifices a plurality of rod attachment assemblies along the said rods supporting and maintaining the same rod alignment and spacing each of said attachment comprising two gold coated metal discs clamped on either side of an insulator disk having interrupted holes to mate and attach to half of said alternate rods and to clear the other half of said alternate rods each of said metal disks having interrupted hole pattern enclosing half or slightly more than half of the rod circumference to allow maximum area for attachment strength, minimal electric fringing fields, and minimal amount of gas throughput when placed between two vacuum pumping stages a mounting ring clamped on to the attachment assemblies around the said rods maintaining an alignment between the mass spectrometer instrument and the rod assembly an exit lens concentrically aligned to the rod assembly and situated cylindrically around and at the exit end of the rod assembly supported by the insulator spacers from the attachment assembly.

2. A rod assembly for ion guides or mass spectrometers as in claim 1 when gold coated rods and the gold coated metal disks in attachment assemblies are soldered together.

* * * * *